United States Patent [19]

Schaefer

[11] Patent Number: 4,515,655

[45] Date of Patent: May 7, 1985

[54] METHOD OF BLEACHING PAPER PULP BY BLENDING CHLORINE WITH A FLOW VOLUME OF PAPER PULP SLURRY

[75] Inventor: Ernst H. Schaefer, Darien, Conn.

[73] Assignee: Westvaco Corporation, New York, N.Y.

[21] Appl. No.: 522,793

[22] Filed: Aug. 15, 1983

[51] Int. Cl.[3] ..... B01F 3/04; D21C 9/12

[52] U.S. Cl. ..... 162/57; 162/66; 261/76; 366/107

[58] Field of Search ..... 162/57, 236, 66, 67, 162/68, 87; 261/76; 366/107, 341, 101; 8/156, 108 R

[56] References Cited

U.S. PATENT DOCUMENTS

| | | | |
|---|---|---|---|
| 1,962,571 | 6/1934 | Ornstein | 261/76 |
| 2,307,509 | 1/1943 | Joachim et al. | 366/107 |
| 3,095,349 | 6/1963 | Rich | 162/236 |
| 3,293,117 | 12/1966 | Pennington et al. | 162/236 |
| 3,301,027 | 1/1967 | Rich | 162/57 |
| 3,630,828 | 12/1971 | Liebergott et al. | 162/24 |
| 3,655,343 | 4/1972 | Galeno | 261/76 |
| 3,759,784 | 9/1973 | Greene | 162/87 |
| 3,833,719 | 9/1974 | Kuerten et al. | 261/76 |
| 3,835,048 | 9/1974 | Walter | 261/76 |
| 3,966,542 | 6/1976 | Oldshue | 162/57 |
| 4,019,983 | 4/1977 | Mandt | 261/76 |
| 4,093,506 | 6/1978 | Richter | 162/57 |

*Primary Examiner*—Steve Alvo

*Attorney, Agent, or Firm*—W. A. Marcontell; R. L. Schmalz

[57] ABSTRACT

Gaseous chlorine is blended with a paper pulp slurry flow stream for pulp bleaching by mixing the chlorine with a larger quantity of steam prior to blending the chlorine/steam gas mixture with bleach washer filtrate which serves as carrier water for a multiplied number of gas bubbles entrained in the filtrate. As the cooler filtrate water extracts heat from the mixed gas bubble, the steam constituent condenses to collapse each bubble to a fraction of the original volume thereby providing a larger number of smaller chlorine bubbles than otherwise available from conventional phase mixing injectors.

The mixed phase flow stream of chlorine and filtrate is thereafter blended with the pulp slurry flow stream by shear induced turbulence resulting from a greater injection velocity of the mixed phase stream into the center of the slower moving slurry stream.

1 Claim, 7 Drawing Figures

FIG. 1 PRIOR ART
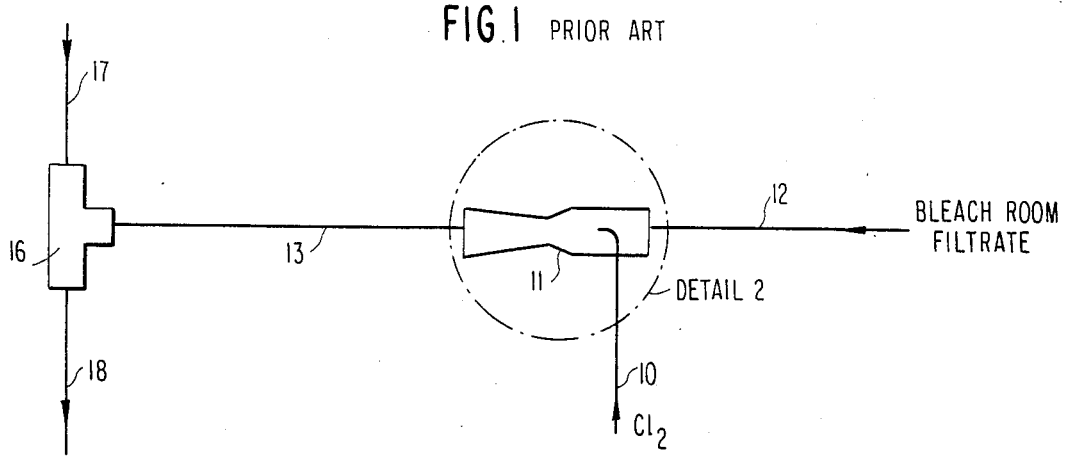
FIG. 2 PRIOR ART
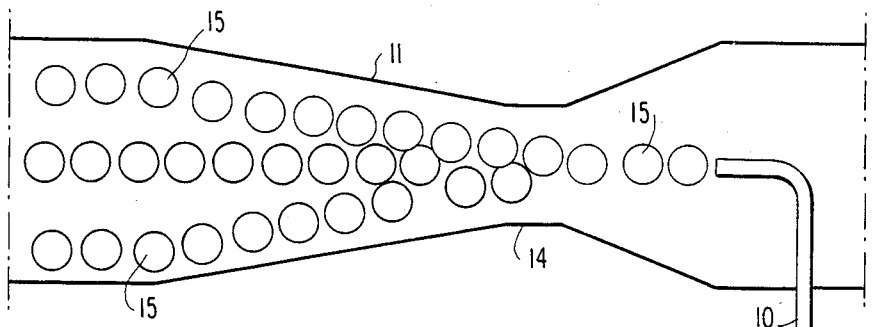
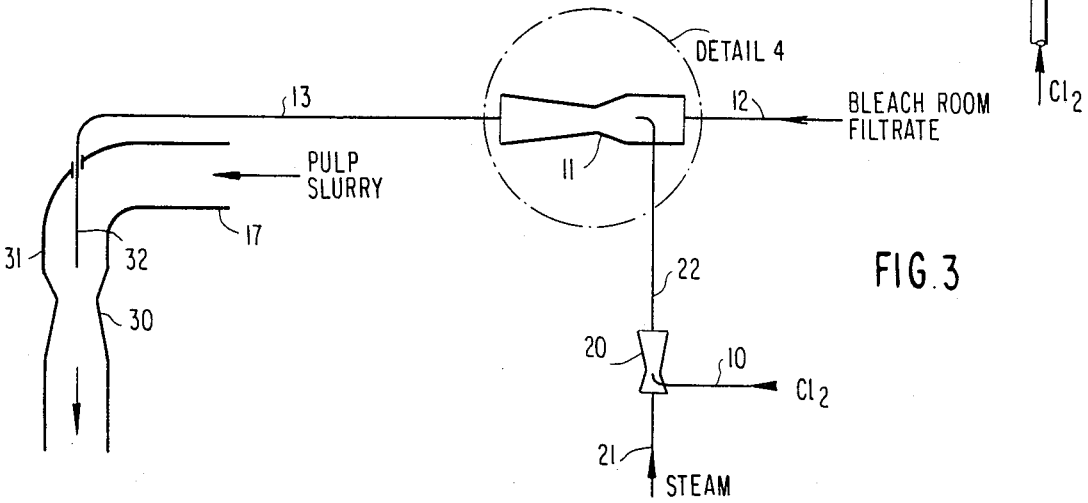
FIG. 3
FIG. 4
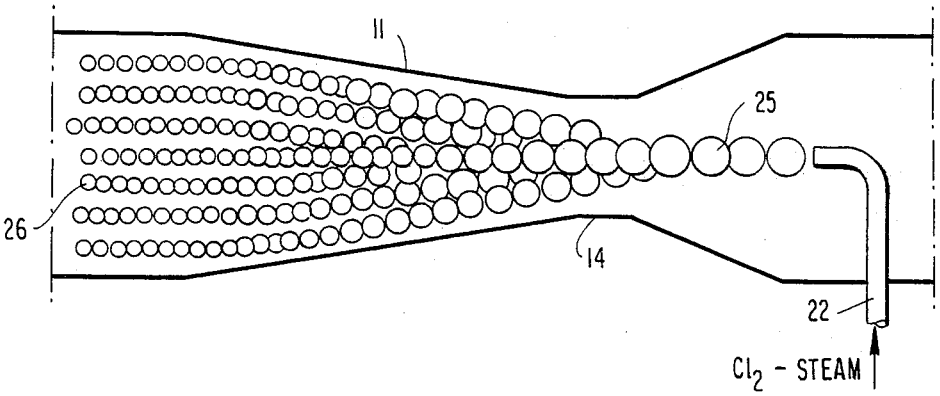

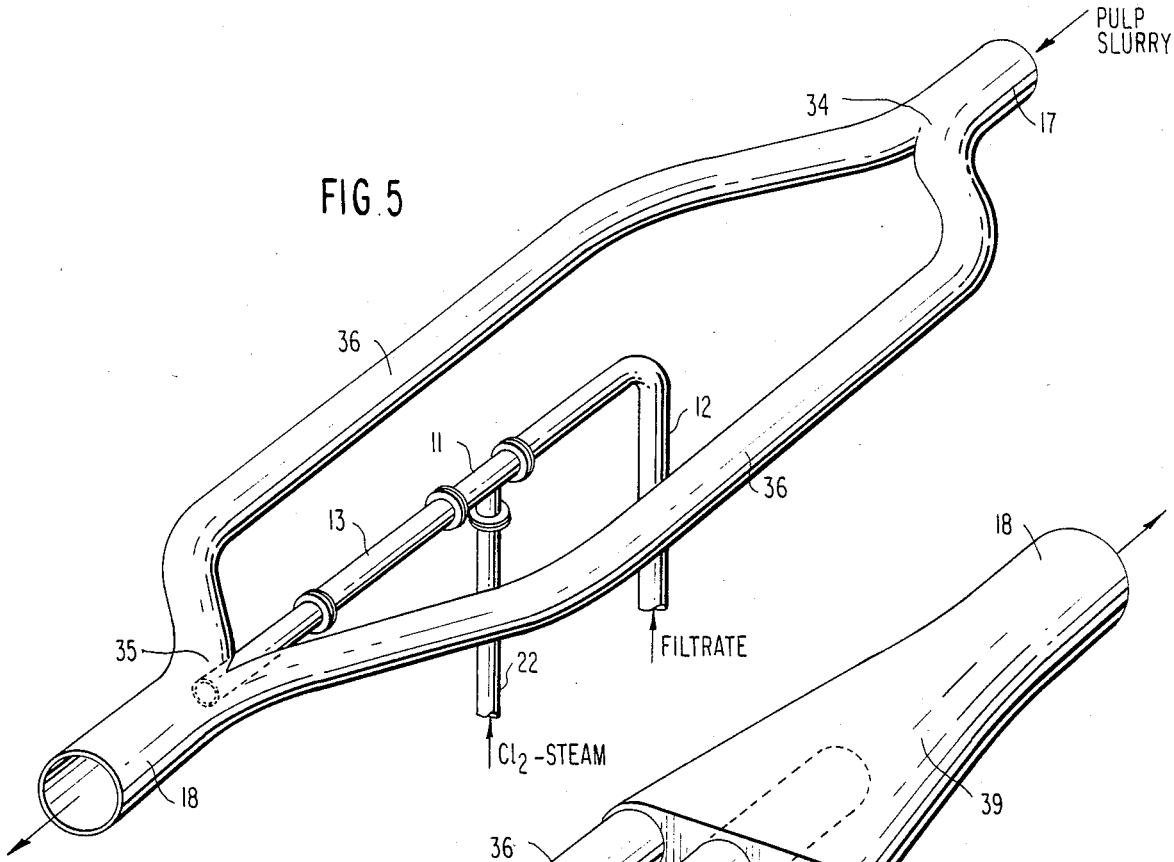
FIG. 5
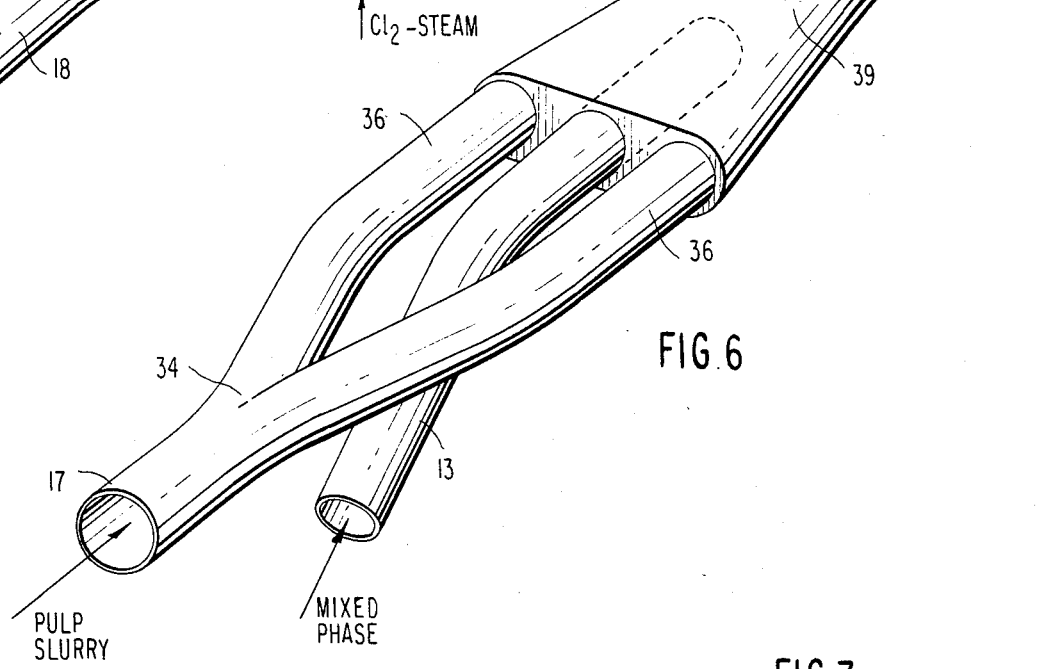
FIG. 6
FIG. 7
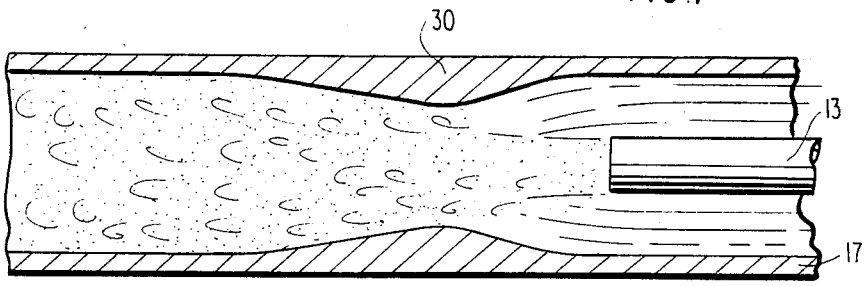

METHOD OF BLEACHING PAPER PULP BY BLENDING CHLORINE WITH A FLOW VOLUME OF PAPER PULP SLURRY

BACKGROUND OF THE INVENTION

1. Field Of The Invention

The present invention relates to the dispersal of a reaction process gas into a liquid carrier stream. More particularly, the present invention relates to the dispersal of chlorine in a paper pulp slurry for the purpose of pulp bleaching.

2. Prior Art

Essential to successful wood pulp bleaching is good dispersal of chlorine among the fibers of the pulp stock flow stream. On a weight ratio basis of elemental chlorine to oven dry pulp, only 4 to 6% chlorine is required. Although chlorine is generally considered to be highly soluble in water, the 4% to 6% chlorine required by the pulp in the residence time permitted by the bleach flow stream may exceed the solution capacity of the water vehicle which suspends the pulp as an aqueous slurry. In other words, a 3% solids consistency pulp slurry may comprise 1,000 lbs./min. of pulp dispersed in 30,500 lbs./min. of water. To bleach the 1,000 lbs./min. of pulp with 6% chlorine requires a chlorine flow rate of 60 lbs./min. However, for distribution to the 1,000 lbs./min. of pulp dispersed in 30,500 lbs./min. of water, 1.67 lbs. of chlorine per minute must be dissolved in a water volume flow rate of 100 gallons per minute (1.67 lbs. $Cl_2$/100 gal. $H_2O$).

At the temperatures and pressures normally used in this process, water will accept only 9.5 lbs. of chlorine per 100 gallons of water. This is an equilibrium ratio achieved after an extended period of time (hours) in agitated mixing. In a typical pulp mill bleach line, however, only 15 to 30 minutes are allotted to dissolve nearly 20% of the equilibrium capacity of the pulp slurry flow stream for chlorine. Such demands tend to press the solubility rate limits of the chemical system. For such reasons, mixers and other mechanical devices are often employed to assist the effort.

To compound the difficulties of achieving chlorine solution and uniform distribution within a pulp slurry flow stream is the physical circumstance that under standard conditions chlorine is a gas. Consequently, for economic reasons, the element is cooled and pressurized to the liquid state for large quantity transport. This necessitates heating and revaporization at the point of use to prevent explosive phase transfer when the element is blended with a pulp slurry.

In the normal course of preblending preparations, gaseous chlorine is combined with a liquid carrier flow stream of filtrate from chlorine and/or chlorine dioxide washers, for example. The liquid filtrate flow stream is then entrained with gaseous chlorine bubbles. The bubble entrained filtrate stream is subsequently blended with the primary stock flow stream.

The size and number of entrainment bubbles greatly influences the uniformity of a bleaching result. Obviously, more uniform distribution of the chlorine may be obtained from a large number of very small bubbles entrained in the carrier stream than a small number of relatively large bubbles, the absolute quantity of chlorine being the same in either case.

Although the bubble size of an entrainment apparatus such as a phase mixing injector may be controlled to a small degree by injector design, the most significant factor of bubble size is the pressure differential between the gas and liquid flow streams i.e.

$$\frac{1}{\sqrt[3]{\Delta P}}$$

where $\Delta P$ is the pressure drop across the injector. As applied to a pulp stream chlorination unit, however, the pressure differential obtainable is limited by practical considerations.

For example, the static head and fluid friction losses in a chlorination system including the tower determine the backpressure for the chlorine-water injector which is usually in the order of 40 psig. Pressures typical to the chlorine supply system are in the order of 60 to 80 psig. A practical adjustment in either of these pressures would only marginally decrease the size of chlorine bubbles created by the injector. Even doubling of the $\Delta P$ would only reduce the bubble size by 21%.

It is therefore, an object of the present invention to provide a method of dramatically decreasing the bubble size for gaseous chlorine added to a paper stock flow stream.

Another object of the invention is to accelerate the bleach reaction time for chlorine in a paper stock flow stream.

Another object of the present invention is to distribute bleaching chlorine more uniformly throughout a pulp stock flow stream.

SUMMARY OF THE INVENTION

These and other objects of the invention are accomplished by the method of first blending the gaseous chlorine with a process compatible intermediate gas such as steam so as to provide a chlorine/steam mixture having a total volume quantity several times greater than the chlorine alone. This gas mixture is thereafter combined with an increased flow rate quantity of liquid carrier such as bleach room filtrate.

As the gas mixture enters the liquid carrier stream, it does so in a train of bubbles just as in the case of injecting pure chlorine, the bubbles of the mixed gas system being of approximately the same size as those of the pure chlorine system for the same $\Delta P$. However, due to the increased volumetric quantity of mixed gas to be injected, the number of such mixed gas bubbles is multiplied accordingly.

Consequential to the temperature differential between the steam and the carrier liquid, heat extracted from the mixed gas bubble causes the steam fraction of the bubble to condense leaving only the chlorine fraction to support a residual bubble of much smaller size.

As the bubble entrained liquid carrier mixes with the fiber stock stream, it carries the desired weight quantity of chlorine in the form of a greatly multiplied number of bubbles, each of only a fraction the size of an injector formed bubble.

Such increased number of smaller sized bubbles provides a greater quantity of chlorine/water interface area for accelerated chlorine dissolution and fiber reaction.

BRIEF DESCRIPTION OF THE DRAWING

Relative to the several figures of the drawings, like reference characters designate like or similar elements throughout the several figures:

FIG. 1 is a schematic of a prior art system for blending gaseous chlorine with a paper pulp slurry.

FIG. 2 is a sectional detail of the prior art chlorine and carrier water mixing injector.

FIG. 3 is a schematic of the present invention system for blending gaseous chlorine with a paper pulp slurry.

FIG. 4 is a sectional detail of the present invention phase mixing injector for blending the steam-chlorine gas mixture with carrier water.

FIG. 5 is an isometric pictorial of a piping configuration for blending gas bubble entrained carrier water with a pulp slurry flow stream.

FIG. 6 is an isometric pictorial of another piping configuration for blending gas bubble entrained carrier water with a pulp slurry flow stream.

FIG. 7 illustrates the mixing dynamics of shear induced turbulence within a phase mixing injector.

DESCRIPTION OF THE PREFERRED EMBODIMENT

The subject invention is readily understood by comparison to a typical prior art system represented by FIGS. 1 and 2 wherein a gaseous chlorine weight flow rate quantity of approximately 5% of the oven dry pulp weight flow rate is delivered through conduit 10 to an injector appliance 11 at about 60 psig. Simultaneously, the injector 11 is supplied with dilution or carrier water by conduit 12 at about 80 psig. Such carrier water is normally derived as filtrate from the chlorine and/or chlorine dioxide washers which volumetrically represents about 4–5% of the pulp slurry volume flow rate with which the carrier water is to be combined. From the detailed enlargement of FIG. 2, the gaseous chlorine is released as a flow of bubbles 15 on the high pressure side of the injector 11 throat 14 which disperses across the flow cross-section on the low pressure side of the throat 14. This bubble entrained flow of carrier water is delivered by conduit 13 into a mixing tee 16 for combination with the pulp slurry stream delivered through conduit 17. The chlorine combined pulp slurry is carried away by conduit 18 to the bleaching tower not shown.

A particular note to be taken from the FIG. 2 representation is that the chlorine bubbles 15 diminish slowly in volume as the 100% gaseous chlorine bubble dissolves into the carrier water for reaction availability. The initial volumetric size of the bubbles 15 is a substantial constant for the injector and pressure system given. Consequently, the number of bubbles 15 available for chlorine dispersal is a function of the chlorine weight quantity per bubble and the chlorine flow rate.

The present invention is represented schematically by FIG. 3 wherein the gaseous chlorine conduit 10 is directed into a gas mixing injector 20. The chlorine is first combined with a steam flow rate from conduit 21 of approximately four times greater by volume than the chlorine flow rate. Emerging from the gas mixing injector 20 is a thoroughly dispersed gas mixture of chlorine and steam delivered by gas mixture conduit 22 to the phase mixing injector 11. However, the volumetric flow rate quantity of gas delivered to the injector 11 is, for example, five times greater than in the prior art system of FIG. 1. Commensurate with this larger flow rate of gas to be mixed with carrier water from conduit 12 is a larger flow rate of carrier water which may be in the order of one-third of the slurry flow volume.

As the steam/chlorine gas mixture leaves the injector delivery conduit 22 for direct combination with the carrier water flow stream, the individual bubbles 25 are initially of about the same size as the pure chlorine bubbles 15 in the prior art system. Due to the greater volumetric flow rate of mixed gas, however, the absolute number of such bubbles is substantially greater. Nevertheless, the total weight flow rate quantity of chlorine remains the same as for a prior art system.

Freshly withdrawn carrier water normally has a temperature of about 115° F. to 160° F. This enthalpy level of the carrier flow stream provides sufficient sensible heat absorption capacity to condense the steam constituent of the mixed gas stream. Such condensation results in a rapid diminution of the bubble size causing its collapse to a volumetric size commensurate with the proportional quantity of chlorine present in the original gas mixture which may be, for example, only one quarter of the original volume.

The dynamics of this bubble size reduction is represented by FIG. 4 wherein bubbles 25 of the same approximate size as pure chlorine bubbles 15 originate from the mixed gas supply conduit 22. As the bubble flow stream emerges from the injector throat area 14, they disperse in lines of stream flow with the carrier water stream. Simultaneously, heat extracted from the bubbles causes a condensation of the steam constituent thereby providing a large number of very fine bubbles 26 which greatly increases the surface area interface between the given weight quantity of remaining chlorine gas and the carrier water for accelerated dissolution of the chlorine into the water.

To effectively disperse this increased number of bubbles, the system of FIG. 3 provides an injector arrangement 30 downstream of an elbow 31 in the pulp slurry supply line 17. The mixed phase supply line 13 connects with a probe 32 which penetrates the elbow to release the bubble entrained phase mixture upstream of the injector 30 flow constriction and in the approximate center of the flow section.

When conditions permit, the mixed phase stream should have a released flow velocity of two to eight times greater than the slurry flow velocity for induction of micro turbulence downstream of the flow restriction 17 as illustrated by FIG. 7.

Examples of other conduit arrangements for induced mixing of steam condensed micro bubbles as generated by the FIG. 3 system with a pulp slurry stream may also take such forms as are shown by FIGS. 5 and 6.

In the FIG. 5 arrangement, the pulp slurry supply conduit 17 is divided and recombined with a pair of back-to-back Y junctures 34 and 35 separated by two parallel conduits 36 having a greater combined flow section area than that of the supply conduit 17 so as to reduce the slurry flow velocity at the reconvergent point 35. Into the crotch of the reconvergent Y 35, the mixed phase conduit 13 penetrates to release the bubble entrained flow stream at two to eight times the point flow velocity of the slurry stream. Such flow velocity differential creates a micro turbulence inducing shear interface with the two, slower moving slurry streams converging upon and enveloping the higher velocity mixed phase stream.

In the FIG. 6 embodiment, parallel legs 36 of a divergent Y 34 leads into a funneled plenum 39 having a greater sectional area at the entrance end to locally reduce the slurry stream velocity. Mixed phase conduit 13 penetrates into the center of the plenum 39 with a release flow velocity greater than the local slurry flow velocity. As in the previous embodiments, a shear interface is created in the center of the slurry flow stream which distributes the chlorine micro bubbles throughout the slurry flow section by shear induced turbulence.

To more fully describe the present invention, the following calculation example is predicated on a 6% application rate of chlorine to be combined with 895 tons per day of oven dry (O.D.) pulp i.e. 53.7 tons per day of chlorine. From standard reference tables, chlorine occupies a specific volume of 1.32 $ft.^3$/lb. at 80 psia and 300° F. Converting, 53.7 tons per day of 300° F., 80 psia chlorine provides a volumetric flow rate of 98.45 $ft.^3$/min.

Assuming that the above chlorine gas flow is to be mixed with a quantity of steam having four times the volumetric flow rate of the chlorine, 393.8 $ft.^3$/min. of 340° F. steam is supplied. Such steam represents a 5.718 $ft.^3$/lb. specific volume and 1197.9 BTU/lb. enthalpy. The weight flow rate of the steam is therefore 68.12 lb./min.

The representative stock bleaching system also provides 1,568 gal/min. of bleach room washer filtrate at 115° F. as gas carrier water. From standard reference sources, 115° F. water carries an enthalpy of 85 BTU/lb. When the 68.12 lb/min. of 1,197.7 BTU/lb. steam is combined with the filtrate, 75,810 BTU/min. will be added to the flow stream, i.e. 67.12 lb/min.×(1197.9−85 BTU/lb.)−75,810 BTU/min. This will cause a temperature rise of 5.8° F. in the filtrate flow stream.

$$75{,}810\ \text{BTU/min.} \times 7.48\ \text{gal/ft.}^3 \times 1\text{min./}1.568\ \text{gal.} \times 1\ \text{ft.}^3/62.4\ \text{lb.} \times 1^\circ\ \text{F.} - \text{lb./BTU} = 5.8^\circ\ \text{F.}$$

The 75,810 BTU/min. heat addition to the system will also cause a 2.06° F. temperature rise in the combined stock slurry flow stream which before combination included the 895 tons per day of O.D. pulp in a 5.25% consistency slurry of 2,838 gal/min. at 115° F.

Adding the total flow components of the system, there are 1,568 gal/min. of filtrate, 8.17 gal/min. of condensed steam (68.12 lbs/min.×1 $ft.^3$/63.4 lbs.×7.48 gal/$ft.^3$=8.17 gal/min.), and 2,838 gal/min. of stock slurry for a total of 4,414 gal/min. In this combined flow, 75,810 BTU/min. are added. Hence, $$75{,}810\ \text{BTU/min.} \times 1\ \text{min./}4{,}414\ \text{gal.} \times 7.48\ \text{gal/ft.}^3 \times 1\ \text{ft.}^3/\ 62.4\ \text{lb.} \times 1^\circ\ \text{F.} - \text{lb./BTU} = 2.06^\circ\ \text{F.}$$

Having fully described my invention, those of skill in the art will readily adopt the principles thereof to other appropriate mixing systems.

As my invention, therefore, I claim:

1. A method of bleaching paper pulp by blending chlorine with a flow volume of paper pulp slurry comprising the steps of:

A. combining a predetermined flow rate of chlorine gas with an approximately four times greater volumetric flow rate of steam to provide a mixed gas flow stream;

B. entraining a liquid phase carrier flow stream comprising approximately one third of the pulp slurry flow volume with bubbles formed from said mixed gas flow stream;

C. condensing the steam constituent of each bubble within said carrier stream to leave a substantially pure chlorine gas bubble of reduced volume;

D. releasing the reduced volume bubble entrained carrier stream with the center of said paper pulp slurry flow volume at a velocity of two to eight times greater than the flow velocity of said slurry flow volume to distribute the bubbles throughout the slurry by shear induced turbulence; and, E. reacting the chlorine with the pulp slurry to bleach the paper pulp.

* * * * *